US011874017B2

(12) United States Patent
Bauch et al.

(10) Patent No.: US 11,874,017 B2
(45) **Date of Patent: *Jan. 16, 2024**

(54) SILENCER ASSEMBLY FOR AIR HANDLING UNIT OF AN HVAC SYSTEM

(71) Applicant: Johnson Controls Tyco IP Holdings LLP, Milwaukee, WI (US)

(72) Inventors: Paul F. Bauch, York, PA (US); Eugene C. Eichelberger, Jr., Harrisburg, PA (US); Rajavel Balaguru, New Cumberland, PA (US); Cody B. Massar, Lee's Summit, MO (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/114,849

(22) Filed: Feb. 27, 2023

(65) Prior Publication Data

US 2023/0204253 A1 Jun. 29, 2023

Related U.S. Application Data

(63) Continuation of application No. 16/388,648, filed on Apr. 18, 2019, now Pat. No. 11,592,205.

(60) Provisional application No. 62/781,444, filed on Dec. 18, 2018.

(51) Int. Cl.
*F24F 13/24* (2006.01)
*F24F 13/02* (2006.01)

(52) U.S. Cl.
CPC ..... *F24F 13/24* (2013.01); *F24F 13/02* (2013.01)

(58) Field of Classification Search
CPC ..... F24F 13/24; F24F 2013/242
USPC ..... 181/224
See application file for complete search history.

(56) References Cited

U.S. PATENT DOCUMENTS 2,916,101 A * 12/1959 Naman ..... G10K 11/172 181/224
3,019,850 A * 2/1962 March ..... F16L 9/003 181/224
3,033,307 A * 5/1962 Sanders ..... B64F 1/26 181/224
3,511,336 A * 5/1970 Rink ..... F04D 29/664 181/224

(Continued)

FOREIGN PATENT DOCUMENTS

EP 2232160 A1 9/2010

*Primary Examiner* — Ko-Wei Lin
(74) *Attorney, Agent, or Firm* — Fletcher Yoder, P.C.

(57) ABSTRACT

The present disclosure relates to a silencer module for a silencer bank of an air handling unit. The silencer module includes a support shell having a first inner wall and a second inner wall opposite the first inner wall. The silencer module also includes a first baffle coupled to the first inner wall, where the first baffle includes a first perforated baffle sheet, and a second baffle coupled to the second inner wall, where the second baffle includes a second perforated baffle sheet. The silencer module further includes an air flow gap that extends between the first perforated baffle sheet and the second perforated baffle sheet, where the air flow gap has a width that is substantially constant along a dimension of the first perforated baffle sheet and the second perforated baffle sheet that extends generally parallel to a direction of air flow through the air flow gap.

20 Claims, 12 Drawing Sheets

(56) References Cited

U.S. PATENT DOCUMENTS 4,287,962 A * 9/1981 Ingard ..... F02M 35/1272 181/268
5,728,980 A * 3/1998 Zarnick ..... F24F 13/0281 181/224
5,869,792 A * 2/1999 Allen ..... F02M 35/1216 181/224
6,386,317 B1 * 5/2002 Morohoshi ..... F02M 35/1266 181/252
6,971,474 B2 * 12/2005 Prosser ..... B60H 1/00564 181/198
7,581,619 B1 9/2009 Storm
8,272,475 B2 9/2012 Helenius et al.
8,459,407 B2 * 6/2013 Jangili ..... F24F 13/24 181/224
9,305,539 B2 * 4/2016 Lind ..... F24F 7/04
9,423,149 B2 8/2016 Martinus
9,574,791 B2 2/2017 Lind et al.
2002/0115406 A1 * 8/2002 Ruach ..... F24F 13/02 454/906
2002/0125068 A1 * 9/2002 Barry ..... F24F 7/02 181/224
2005/0076668 A1 * 4/2005 Choi ..... E04F 17/04 62/426
2005/0161280 A1 * 7/2005 Furuya ..... F01N 1/023 181/224
2006/0237262 A1 * 10/2006 Parlade De Elia ..... F24C 15/20 181/290
2006/0272886 A1 * 12/2006 Mueller ..... F02C 7/24 181/224
2007/0034444 A1 * 2/2007 Yaoita ..... F01N 1/06 181/224
2008/0139107 A1 * 6/2008 Takeda ..... F24F 13/24 454/262
2009/0032330 A1 * 2/2009 Holmgren ..... F24F 13/24 181/224
2010/0077754 A1 * 4/2010 Jangili ..... F01D 25/30 60/725
2010/0077755 A1 * 4/2010 Jangili ..... F01D 25/30 60/725
2012/0160603 A1 * 6/2012 Braybrook ..... F24F 13/082 181/294
2014/0158461 A1 * 6/2014 Bertrand ..... F01N 13/08 181/228
2015/0345514 A1 12/2015 Mercer et al.
2016/0318614 A1 * 11/2016 Bultemeier ..... F24F 13/06
2017/0172014 A1 * 6/2017 LaPree ..... F24F 13/24
2017/0241310 A1 * 8/2017 Hanschen ..... F24F 13/24
2017/0241664 A1 * 8/2017 Mouratidis ..... G10K 11/168
2017/0276397 A1 * 9/2017 Mouratidis ..... F24F 13/08

* cited by examiner

SILENCER ASSEMBLY FOR AIR HANDLING UNIT OF AN HVAC SYSTEM

CROSS-REFERENCE TO RELATED APPLICATIONS

This is a continuation application of U.S. patent application Ser. No. 16/388,648, entitled "SILENCER ASSEMBLY FOR AIR HANDLING UNIT OF AN HVAC SYSTEM," filed Apr. 18, 2019, which claims priority from and the benefit of U.S. Provisional Application No. 62/781,444, entitled "SILENCER ASSEMBLY FOR AN HVAC SYSTEM," filed Dec. 18, 2018, each of which is hereby incorporated by reference in its entirety for all purposes.

BACKGROUND

This disclosure relates generally to heating, ventilation, and/or air conditioning (HVAC) systems. Specifically, the present disclosure relates to a silencer assembly for air handling units.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and/or air conditioning (HVAC) system may be used to thermally regulate an environment, such as a building, home, or other structure. In many cases, an air handling unit of the HVAC system may direct a flow of fresh outdoor air into a building to provide ventilation and improved air quality within the building, while discharging a flow of return air from the building into an ambient environment, such as the atmosphere. Particularly, the air handling unit may include a fan assembly or other flow generating device that facilitates air circulation throughout ductwork of the building. In certain cases, operation of the fan assembly and/or other components of the air handling unit may generate audible noise that propagates through the air handling unit and into the ductwork. Unfortunately, the audible noise generated by the air handling unit may be unpleasant to occupants within the building or persons situated near the building ductwork.

SUMMARY

The present disclosure relates to a silencer module for a silencer bank of an air handling unit. The silencer module includes a support shell having a first inner wall and a second inner wall opposite the first inner wall. The silencer module also includes a first baffle coupled to the first inner wall, where the first baffle includes a first perforated baffle sheet, and a second baffle coupled to the second inner wall, where the second baffle includes a second perforated baffle sheet. The silencer module further includes an air flow gap that extends between the first perforated baffle sheet and the second perforated baffle sheet, where the air flow gap has a width that is substantially constant along a dimension of the first perforated baffle sheet and the second perforated baffle sheet that extends generally parallel to a direction of air flow through the air flow gap.

The present disclosure also relates to a silencer for an air handling unit, where the silencer includes a support frame and a plurality of silencer modules arrayed within the support frame. Each silencer module of the plurality of silencer modules includes a support shell, a first perforated baffle sheet coupled to a first inner wall of the support shell, and a second perforated baffle sheet coupled to a second inner wall of the support shell opposite the first inner wall. An air flow gap extends between the first perforated baffle sheet and the second perforated baffle sheet, where the air flow gap has a width that is substantially constant along a dimension of the first perforated baffle sheet and the second perforated baffle sheet that extends generally parallel to a direction of air flow through the air flow gap.

The present disclosure also relates to a silencer for an air handling unit, where the silencer includes a silencer bank positioned within a support frame. The silencer extends along a height and a width of the support frame and includes a plurality of silencer modules, where a silencer module of the plurality of silencer modules includes a support shell having a perforated baffle sheet coupled to a first inner wall, a second inner wall positioned opposite the first inner wall, and an air flow gap extending between the perforated baffle sheet and the second inner wall. The air flow gap of the silencer module has a width that is substantially constant along a dimension of the perforated baffle sheet that extends generally parallel to a direction of air flow across the silencer bank.

BRIEF DESCRIPTION OF THE DRAWINGS

Various aspects of this disclosure may be better understood upon reading the following detailed description and upon reference to the drawings in which.

DETAILED DESCRIPTION

Figure 1:
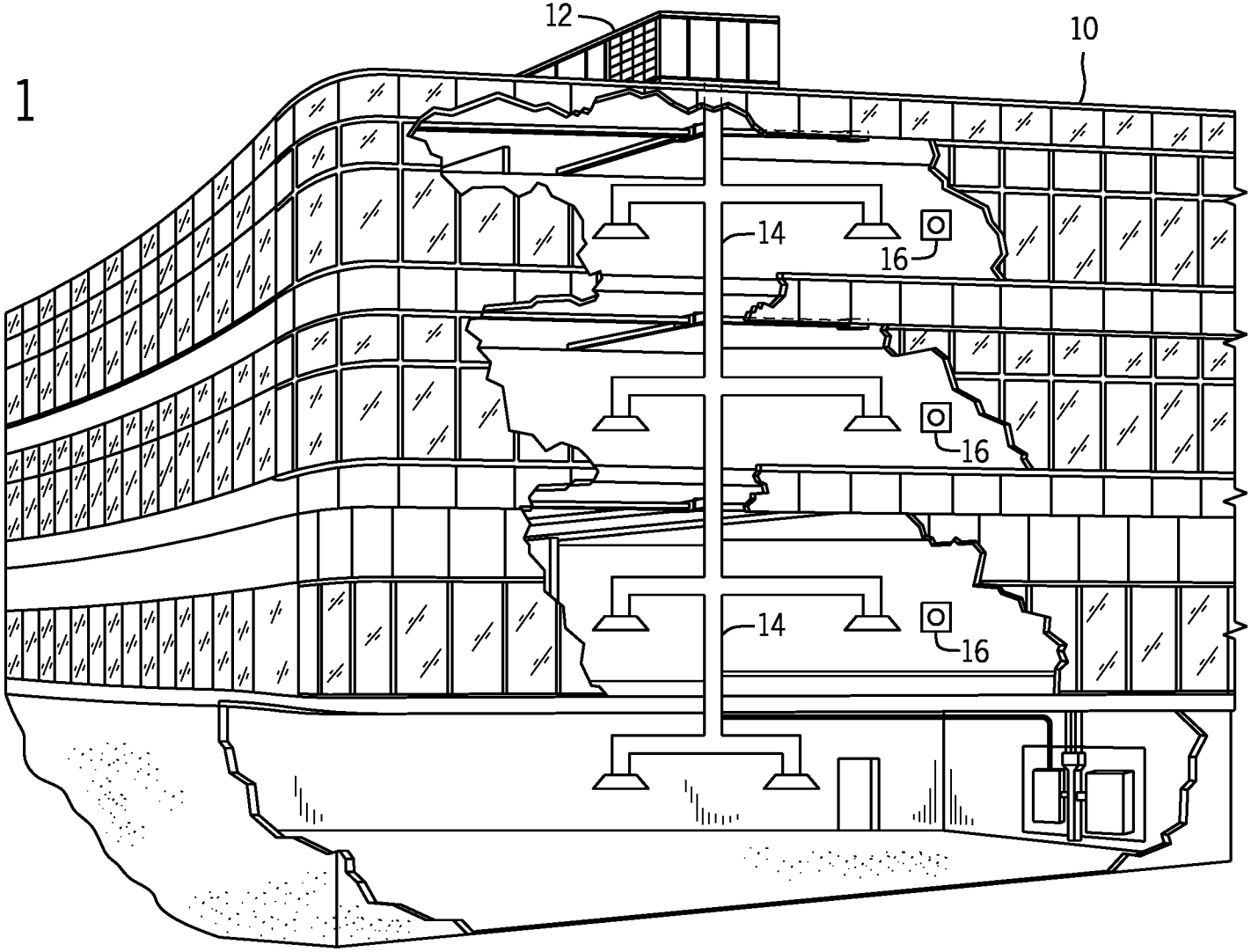
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to regulate certain climate parameters within a space of a building, home, or other suitable structure. For example, the HVAC system may include an air handling unit having a fan or other flow generating device that is positioned within an enclosure of the air handling unit. The enclosure may be in fluid communication with the building or other structure via an air distribution system, such as a system of ductwork, which extends between the enclosure and the building. The fan may be operable to force an air flow along an interior of the enclosure and, thus, direct air into or out of the building. In particular, the fan may enable the air handling unit to exhaust return air from the building while simultaneously directing fresh outdoor air into the building. Accordingly, a supply of fresh air may be circulated through an interior of the building to improve or maintain an air quality within the building.

In some embodiments, operation of the blower or other climate management components of the air handling unit may generate acoustic waves, such as sound waves, or audible noise, which may propagate within the air handling unit enclosure. In certain cases, the generated acoustic waves or sound waves may propagate along the enclosure and the ductwork of the HVAC system and thereby enter the building. Such audible noise may be unpleasant to occupants within the building or persons in proximity to the ductwork. Accordingly, typical air handling units may include one or more conventional in-duct silencers that are disposed within the enclosure of the air handling unit to attenuate propagation of such sound waves. That is, conventional air handling units may be equipped with in-duct silencers that are typically configured for installation within ductwork of the building and are designed to reduce propagation of sound waves through the building ductwork. Unfortunately, in-duct silencers may be ill-equipped or otherwise poorly-suited for implementation within air handling units.

For example, in-duct silencers are generally designed to effectively receive and discharge air at a flow rate that is greater than a flow rate of air typically forced through the enclosure of the air handling unit by a blower or fan assembly of the air handling unit. Moreover, conventional in-duct silencers may be unsuitable to attenuate certain frequencies of sound waves that may be generated by particular components of the air handling unit positioned within or adjacent to the air handling unit enclosure. Instead, conventional in-duct duct silencers are generally designed to attenuate relatively high frequencies of sound waves that may be generated by turbulent air flow throughout the building ductwork and/or air flow through terminal devices, such as variable-air-volume boxes, of the building ductwork. That is, in-duct silencers may be inadequate to effectively attenuate relatively low frequencies of sound waves that may be generated during operation of certain air handling unit components, such as the blower. As a result, installation of conventional in-duct silencers within an air handling unit may reduce an overall acoustic performance of the air handling unit.

It is now recognized that mitigating a pressure differential across silencers of the air handling unit may reduce a load on the blower that drives an air flow through the air handling unit enclosure. For example, a power consumption of the blower may be reduced, thereby improving an overall operational efficiency of the air handling unit. Additionally, it is now recognized that augmenting and/or improving silencers to effectively attenuate particular frequencies of sound waves that may be generated during operation of the air handling unit may reduce a magnitude of sound waves propagating through the enclosure of the air handling unit. As a result, the silencers may reduce a level of sound or audible noise, such as a decibel (dB) level of acoustic noise, which may propagate from the air handling unit and into the ductwork and/or the building.

Accordingly, embodiments of the present disclosure are directed to a silencer assembly that is configured to effectively attenuating certain frequencies of sound waves that may be generated during operation of certain air handling unit components. For example, the silencer assembly may include one or more silencer modules that collectively form a silencer bank of the silencer assembly. The silencer bank may be supported within a support frame of the silencer assembly, which may be coupled to the enclosure of the air handling unit. Various sizes of silencer modules may be used to facilitate assembly of the silencer bank to include exterior dimensions that are substantially similar to interior dimensions of the enclosure. Sizing the silencer bank in such a manner may enable positioning of a relatively large silencer bank within the enclosure, which may enhance an ability of the silencer assembly to attenuate sound waves that may be generated by the air handling unit components.

As discussed in detail below, the various sizes of silencer modules may each be configured to attenuate substantially similar frequencies of sound waves. As a result, an overall size of the assembled silencer bank may be selected based on the size of an air handling unit in which the silencer bank is to be installed, and the assembled silencer bank may be configured to effectively attenuate particular frequencies of sound waves irrespective of the overall size of the silencer bank or a size and/or quantity of the individual silencer modules included in the silencer bank. Accordingly, the silencer assembly may be configured to adequately attenuate predominant frequencies of sound waves that may be generated by the air handling unit, regardless of a size or a configuration of the air handling unit in which the silencer assembly is installed. Therefore, the disclosed silencer modules may be universally implemented in a wide variety of air handling units while mitigating the aforementioned shortcomings of typical in-duct silencers conventionally used in such air handling units. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12, such as an air handling unit (AHU). The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It should be appreciated that any of the features described herein may be incorporated with the HVAC unit 12 or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, HVAC systems generally include an air distribution system, such as a system of ductwork, which extends between the HVAC system and a space to be conditioned, such as a room or zone within a building. In some cases, air flowing through the ductwork may generate audible noise that may be unpleasant to occupants within the rooms or zones of the building. Accordingly, certain HVAC systems may include an in-duct silencer or muffling device that is installed within the ductwork and is configured to attenuate the audible noise. That is, the in-duct silencers may be configured to reduce a magnitude of sound waves that are generated by air flow through the ductwork. As noted above, conventional in-duct duct silencers are generally designed to attenuate relatively high frequencies of sound waves and for use with relatively high flow rates of air. Accordingly, in-duct silencers may be ill-equipped for use within air handling units. That is, in-duct silencers may be inadequate to effectively attenuate relatively low frequencies of sound waves that may be generated during operation of, for example, a blower or fan assembly of the air handling unit.

Accordingly, embodiments of the present disclosure are directed to a silencer assembly that is configured to effectively attenuate predominate frequencies of sound waves that may be generated by components of the air handling unit. Indeed, embodiments of the silencer assembly discussed herein may be configured to attenuate sound waves at a targeted frequency range that are typically generated during operation of an air handling unit, as compared to a frequency range of sound waves conventionally attenuated by in-duct silencers. Particularly, as noted above, the silencer assembly may be configured to effectively attenuate relatively low frequencies of sound waves that may be generated during operation of the air handling unit. Moreover, the silencer assembly may allow air flow along an enclosure of the air handling unit while generating a marginal or substantially negligible pressure drop across the silencer assembly and along an air flow path of the enclosure.

Figure 2:
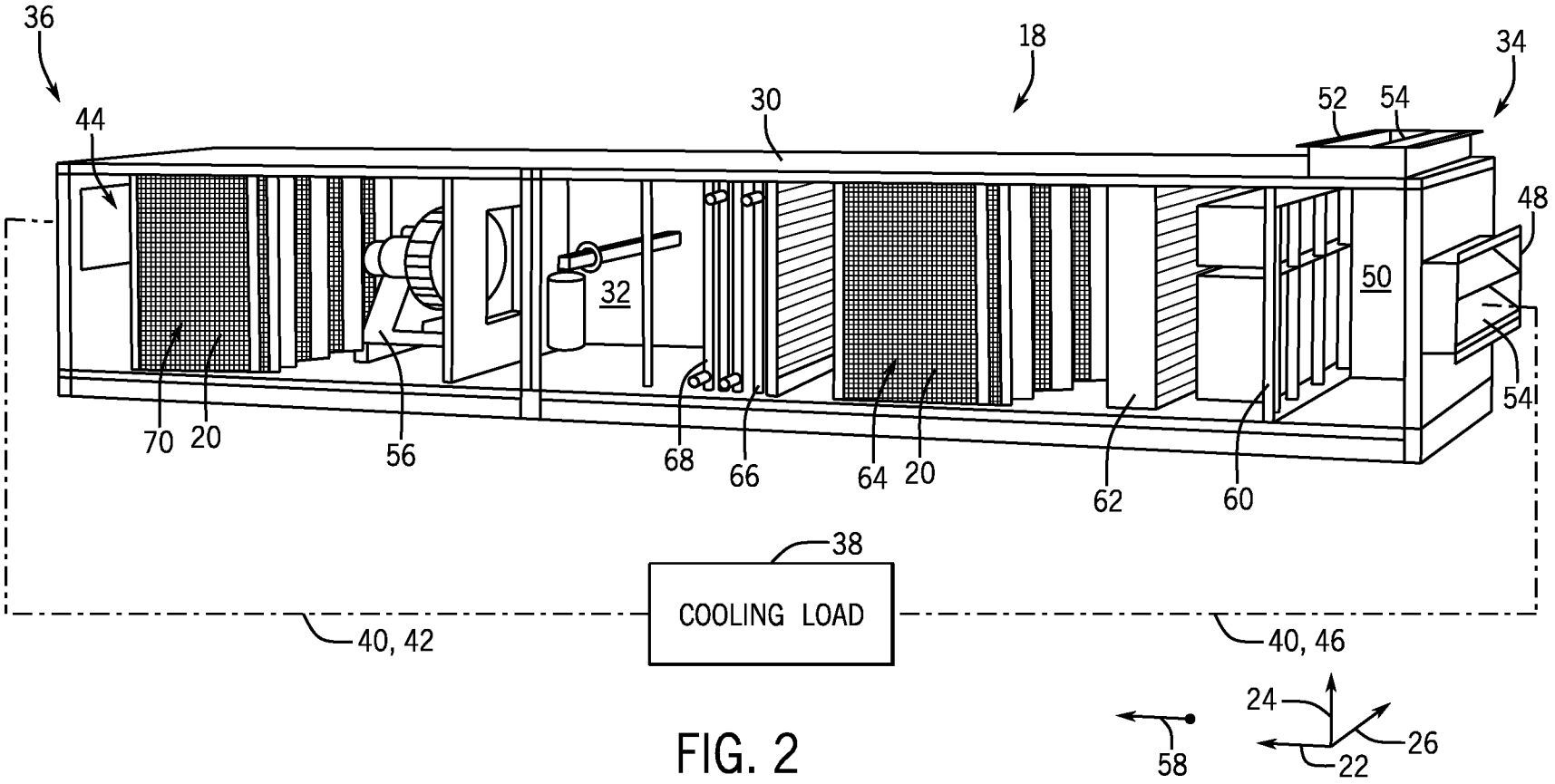
FIG. 2 is a perspective view of an embodiment of an air handling unit that may be used in an HVAC system, in accordance with an aspect of the present disclosure.

With the foregoing in mind, FIG. 2 is a perspective view of an embodiment of an air handling unit 18 that includes a pair of silencer assemblies 20. It should be noted that the air handling unit 18 may include embodiments or components of the HVAC unit 12 shown in FIG. 1, a rooftop unit (RTU), or any other suitable air handling unit or HVAC system. To facilitate discussion, the air handling unit 18, the silencer assemblies 20, and their respective components, will be described with reference to a longitudinal axis 22, a vertical axis 24, which is oriented relative to gravity, and a lateral axis 26. As discussed below, in some embodiments, the air handling unit 18 may provide a variety of air filtration functions and heating and/or cooling functions, such as cooling only, heating only, cooling with electric heat, cooling with hydronic heat exchangers, cooling with dehumidification, cooling with gas heat, or cooling with a heat pump. Accordingly, the air handling unit 18 may circulate a flow of conditioned air through a space within the building 10 or other suitable structure.

As shown in the illustrated embodiment, the air handling unit 18 includes an enclosure 30 that forms an air flow path 32 through the air handling unit 18, which extends from an upstream end portion 34 of the air handling unit 18 to a downstream end portion 36 of the air handling unit 18. The enclosure 30 may be in fluid communication with a cooling load 38, such as the building 10, via an air distribution system, or a system of ductwork, which is represented by dashed lines 40. Particularly, the air distribution system 40 includes a supply duct 42 that is coupled to a supply air outlet 44 of the air handling unit 18 and a return duct 46 that is coupled to a return air inlet 48 of the air handling unit 18. Accordingly, the supply duct 42 and the return duct 46 may fluidly couple the air flow path 32 to the cooling load 38.

In the illustrated embodiment, the air handling unit 18 includes an inlet plenum 50 that is in fluid communication with the return air inlet 48 and an outside air inlet 52. The return air inlet 48 and the outside air inlet 52 may each include respective dampers 54 that are configured to regulate a flow rate of return air and/or a flow rate of outside air that may be drawn into the inlet plenum 50 via a fan 56 of the air handling unit 18. In particular, the fan 56 is configured to draw the return air and/or the outside air, collectively referred to herein as supply air, along the air flow path 32 in a downstream direction 58, from the upstream end portion 34 to the downstream end portion 36 of the air handling unit 18.

In some embodiments, the air handling unit 18 may include a filter rack 60 and an ionization filter 62 that are configured to filter the supply air before the fan 56 draws the supply air through a silencer assembly 64 of the pair of silencer assemblies 20. Particularly, the filter rack 60 and the ionization filter 62 may include a plurality of filtration elements that are configured to remove airborne particulates, such as dust or pollen, from the flow of supply air. The fan 56 may draw the filtered supply air across a cooling coil 66 and a heating coil 68, which may be configured to cool and heat, respectively the flow of supply air. For example, in a cooling mode of the air handling unit 18, chilled liquid, such as chilled water, may be circulated through the cooling coil 66 while the heating coil 68 is non-operational. In this manner, the chilled liquid circulating through the cooling coil 66 may absorb thermal energy from the supply air flowing across a heat exchange area of the cooling coil 66. Conversely, in a heating mode of the air handling unit 18, a heated liquid, such as heated water, may be circulated through the heating coil 68, while the cooling coil 66 is non-operational. Accordingly, the heating coil 68 may transfer thermal energy to the flow of supply air in the heating mode of the air handling unit 18. In any case, the fan 56 may force the conditioned supply air through an additional silencer assembly 70 of the pair of silencer assemblies 20, through the supply air outlet 44, and into the supply duct 42. In accordance with these techniques, the air handling unit 18 may regulate one or more climate parameters and/or air quality parameters within the cooling load 38.

Figure 3:
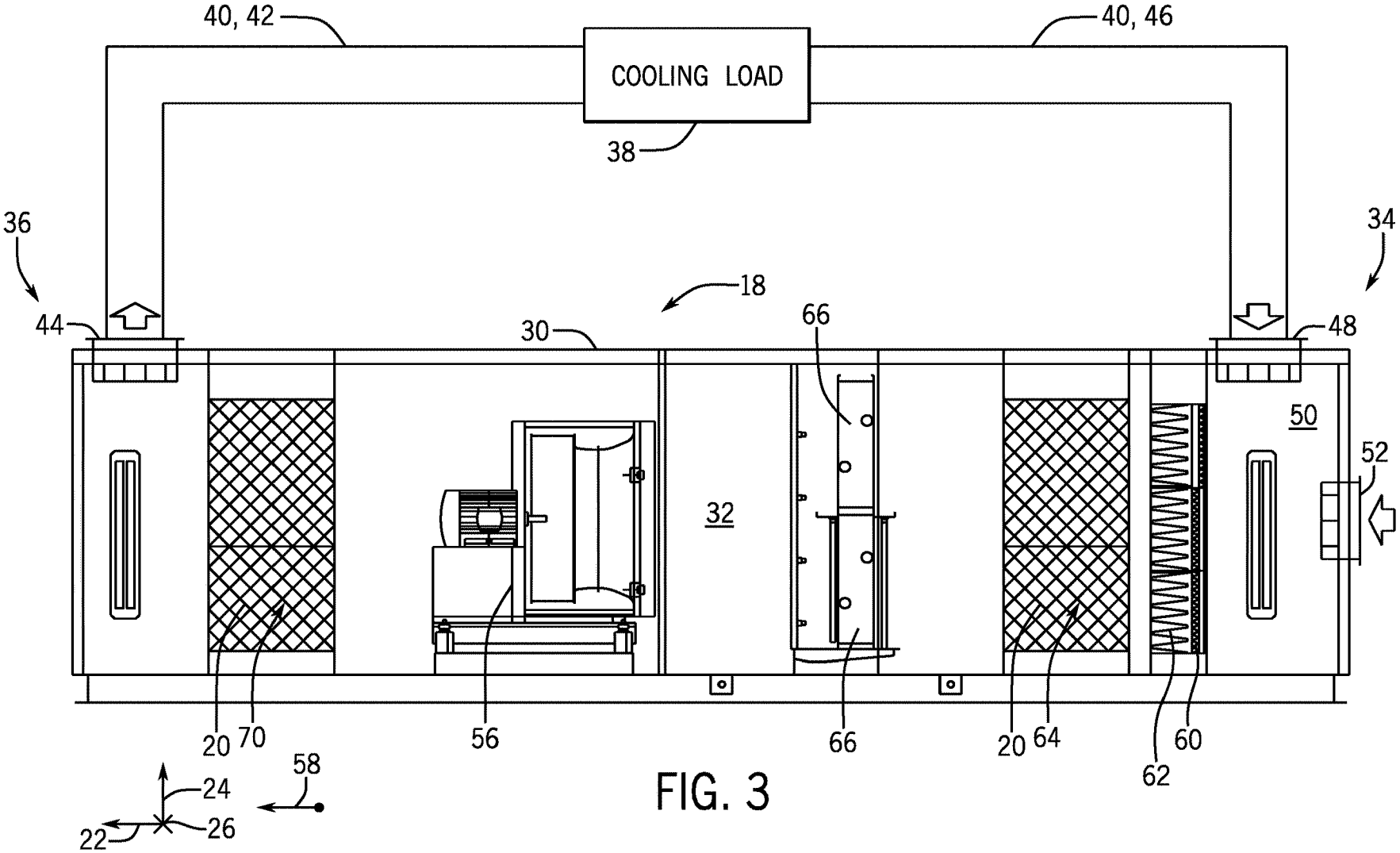
FIG. 3 is a schematic diagram of an embodiment of an air handling unit that may be used in an HVAC system, in accordance with an aspect of the present disclosure.

FIG. 3 is a schematic of an embodiment of the air handling unit 18. In the illustrated embodiment, the fan 56 is positioned between the silencer assemblies 20 within the enclosure 30. Particularly, the silencer assembly 64 is positioned upstream of the fan 56, which respect to a direction of air flow along the enclosure 30, and the additional silencer assembly 70 is positioned downstream of the fan 56, with respect to a direction of air flow along the enclosure 30. However, it should be noted that, in other embodiments, the silencer assemblies 20 may be positioned along any other portion(s) of the air flow path 32 within the enclosure 30. Moreover, in some embodiments, the air handling unit 18 may include a single silencer assembly 20, or more than two silencer assemblies 20, instead of the pair of silencer assemblies 20 shown in FIG. 3. For example, in some embodiments, the air handling unit 18 may include only the silencer assembly 64, which may be positioned between the fan 56 and the heating coil 68, or along another portion of the enclosure 30 that is upstream or downstream of the fan 56, with respect to a direction of air flow through the fan 56.

As noted above, operation of certain components of the air handling unit 18, such as the fan 56 and/or any other components of the air handling unit 18 positioned within or adjacent to the air flow path 32, may generate audible noise in the form of sound waves. The generated sound waves may propagate along the air flow path 32 and, in some cases, may enter the cooling load 38 as audible noise. That is, the generated audible noise may enter the cooling load 38 via the supply duct 42, the return duct 46, or both. Therefore, embodiments of the air handling unit 18 discussed herein may include the silencer assembly 64 and/or the additional silencer assembly 70, which may be configured to substantially block the propagation of sound waves along the air flow path 32 and into the cooling load 38. As discussed in detail below, the silencer assemblies 20 may be separate components that are positioned within the enclosure 30 or may form a portion of the enclosure 30 itself. In any case, the air flow path 32 may extend across the silencer assemblies 20, thereby enabling the silencer assemblies 20 to attenuate sound waves that may propagate along the air flow path 32.

For clarity, it should be noted that, in some embodiments, the additional silencer assembly 70 may be substantially similar to the silencer assembly 64. That is, the additional silencer assembly 70 may include some or all of the components of the silencer assembly 64 discussed herein, and may be used interchangeably with the silencer assembly 64. Accordingly, for conciseness, only the silencer assembly 64 will be described with reference to FIGS. 4-12 below.

Figure 4:
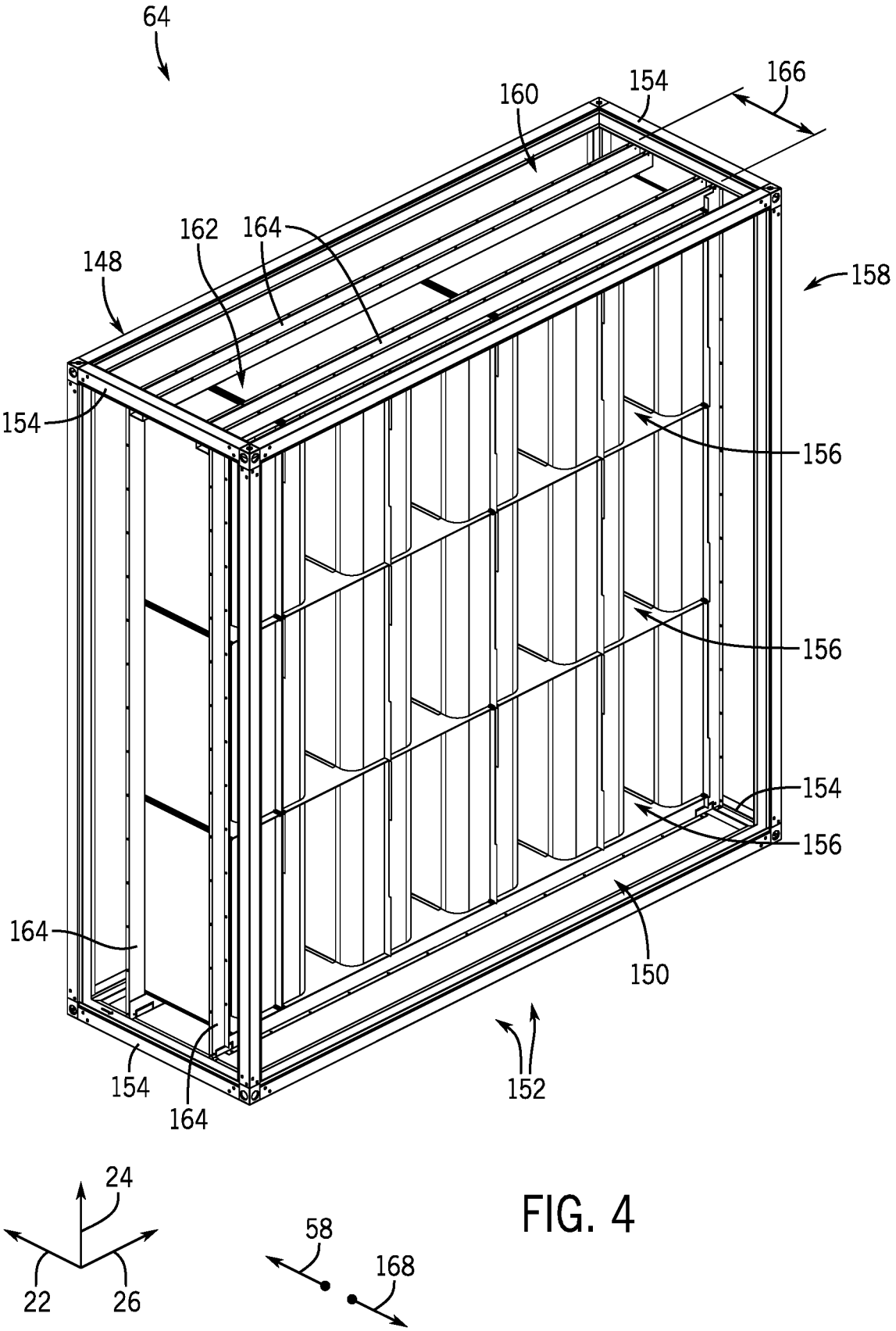
FIG. 4 is a perspective view of an embodiment of a silencer assembly, in accordance with an aspect of the present disclosure.

To facilitate discussion of the silencer assembly 64 and its components, FIG. 4 is a perspective view of an embodiment of the silencer assembly 64. It should be noted that the following discussion with reference to FIG. 4 is intended to briefly introduce various components and subassemblies of the silencer assembly 64, which will be described in further detail with reference to FIGS. 5-12. With the foregoing in mind, FIG. 4 illustrates a support frame 148 of the silencer assembly 64, which may include a portion of the enclosure 30, which is configured to couple to and support a silencer bank 150. The silencer bank 150 includes a plurality of silencer modules 152 that, as described in detail below, are configured to attenuate sound waves that may propagate along the air flow path 32. In some embodiments, the support frame 148 may be a component of the enclosure 30 and may therefore form a portion of the enclosure 30. For example, frame rails 154 of the support frame 148 may be configured to couple to frame rails of the enclosure 30, thereby securing the silencer assembly 64 to the air handling unit 18. However, it should be noted that, in other embodiments, the support frame 148 may be a component of the air handling unit 18 that is separate of the enclosure 30. In other words, in such embodiments, the support frame 148 may not form a portion of the enclosure 30 itself and, instead, may be positioned within an interior of the enclosure 30.

In any case, as shown in the illustrated embodiment, the silencer modules 152 may define a plurality of air flow paths, referred to herein as air gaps 156, which extend through the silencer bank 150 from respective first end portions 158 of the silencer modules 152 to respective second end portions 160 of the silencer modules 152. Accordingly, the air gaps 156 form a portion of the air flow path 32 that extends across the silencer assembly 64. As discussed below, one or more panels of the enclosure 30 may be coupled to the support frame 148 and may be configured to encompass or surround an outer perimeter 162 of the silencer bank 150. The silencer assembly 64 may include blank-off panels 164 that extend between these panels of the enclosure 30 and the outer perimeter 162 of the silencer bank 150 to block air flow between the panels and the silencer bank 150. Accordingly, the fan 56 may direct substantially all air flowing along the air flow path 32 through the air gaps 156 of the silencer modules 152. That is, the blank-off panels 164 may substantially block air flow from bypassing the silencer modules 152 by flowing between the silencer bank 150 and the panels of the enclosure 30.

The silencer modules 152 may each include a sound absorbing material or a noise attenuating material disposed therein, which is configured to mitigate the propagation of sound waves across and from the silencer bank 150. That is, the noise attenuating material may substantially impede the propagation of sound waves through the air gaps 156 from the first end portions 158 of the silencer modules 152 to the second end portions 160 of the silencer modules 152, or vice versa. As discussed in detail below, the air gaps 156 may be sized to allow relatively unimpeded air flow across the silencer bank 150 while maintaining a desired acoustic performance of the silencer assembly 64. For clarity, as used herein, "acoustic performance" refers to an ability of the silencer bank 150 to attenuate particular frequencies of sound waves that may otherwise propagate across the silencer bank 150. That is, the "acoustic performance" of the silencer assembly 64 may refer to the ability of the silencer bank 150 to diminish an amplitude of certain frequencies of sound waves and impede propagation of these frequencies of sound waves across a depth 166 of the silencer bank 150 in the downstream direction 58, in an upstream direction 168, opposite the downstream direction 58, or both. As discussed below, the silencer bank 150 may be configured to effectively attenuate sound waves irrespective of a direction of air flow across the silencer bank 150. That is, the silencer bank 150 may be bi-directional, such that the silencer bank 150 may receive an air flow passing in the downstream direction 58 or the upstream direction 168, and the acoustic performance of the silencer assembly 64 may remain substantially identical regardless of whether the air flow traverses the silencer bank 150 in the downstream direction 58 or the upstream direction 168.

Figure 5:
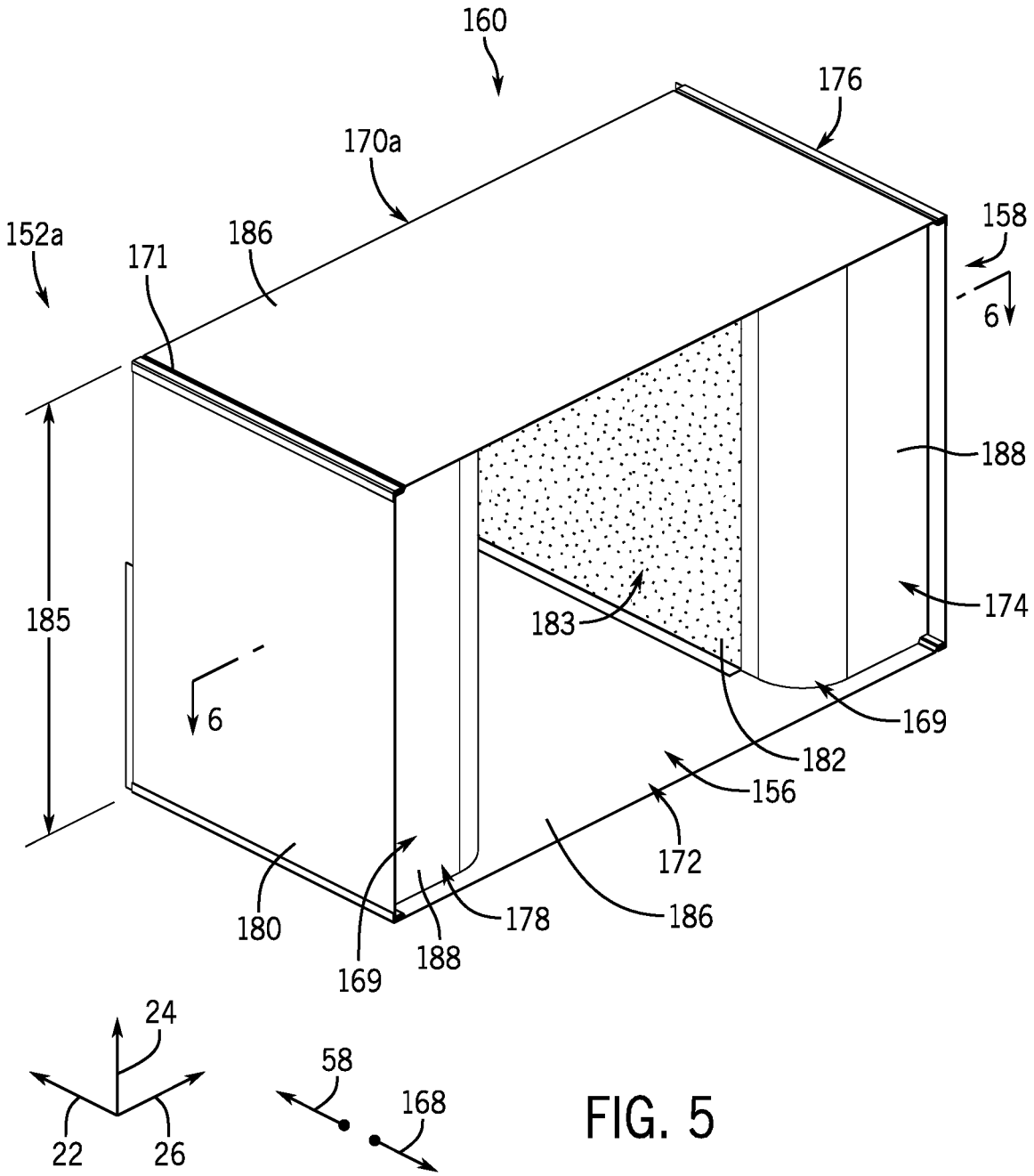
FIG. 5 is a perspective view of an embodiment of a silencer module for a silencer assembly, in accordance with an aspect of the present disclosure.

With the foregoing in mind, FIG. 5 is a perspective view of an embodiment of a silencer module 152 of the silencer bank 150. In particular, the illustrated embodiment shows a silencer module 152*a* having a pair of baffles 169 that, as discussed in detail below, enable the silencer module 152*a* to attenuate sound waves. As shown in the illustrated embodiment, the silencer module 152*a* includes a support shell 170*a* that may form an outer perimeter of the silencer module 152*a*. In some embodiments, the support shell 170*a* may include a single piece component that is formed from a continuous piece of material. For example, the support shell 170*a* may be formed of sheet metal that is bent or deformed into the illustrated shape of the support shell 170*a* and is coupled at a seam 171. In other embodiments, the support shell 170*a* may be formed from multiple panels of material that may be coupled to one another via suitable fasteners, such as rivets, friction pins, and/or bolts, or suitable adhesives, such as bonding glue. In any case, the support shell 170*a* defines a flow path 172 through the silencer module 152*a* that extends from the first end portion 158 to the second end portion 160 of the silencer module 152*a*.

Figure 6:
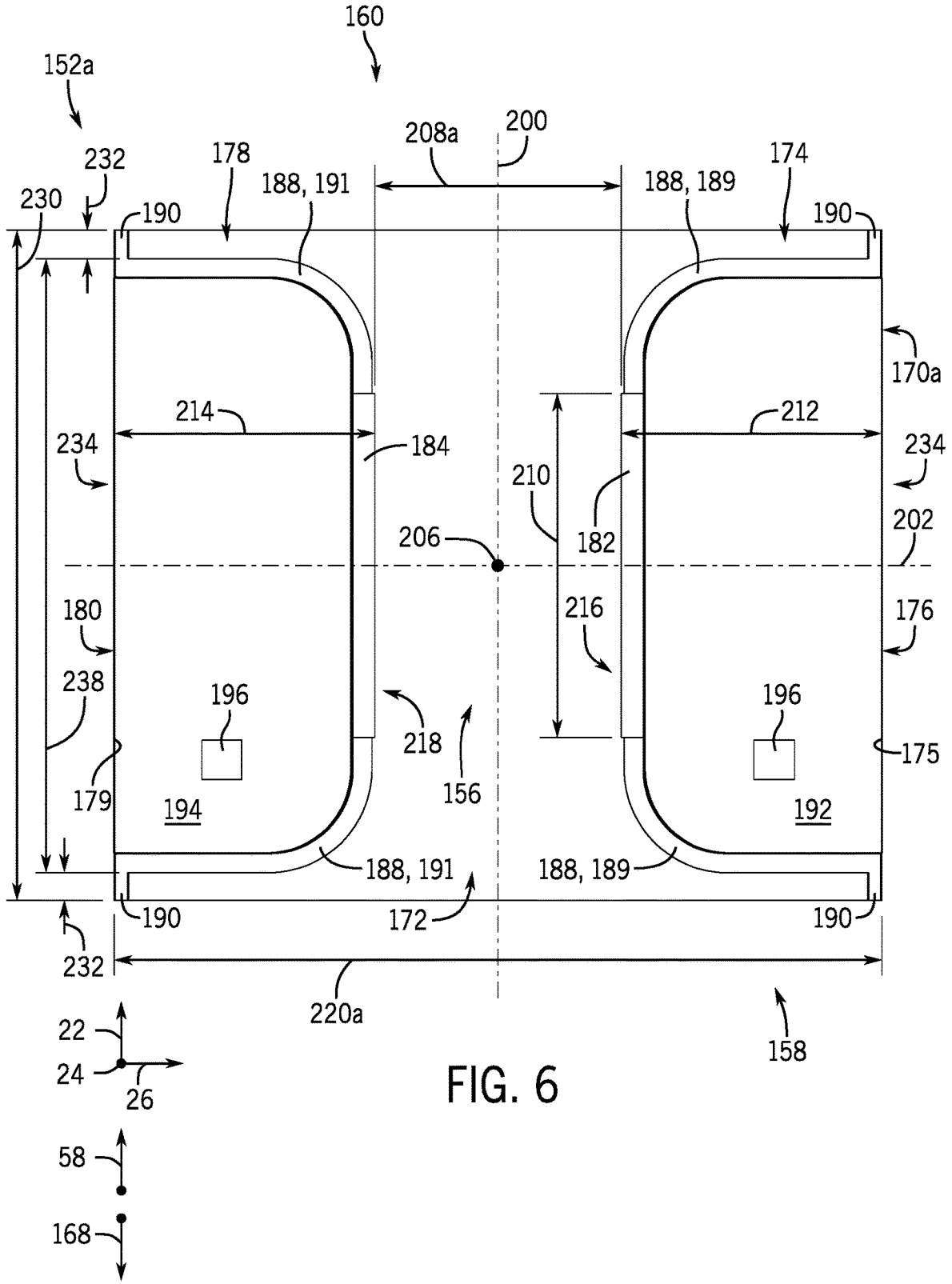
FIG. 6 is a cross-sectional top view of an embodiment of the silencer module of FIG. 5, in accordance with an aspect of the present disclosure.

As shown in the illustrated embodiment, the silencer module 152*a* may include a first baffle 174 that may be coupled to a first inner wall 175, as shown in FIG. 6, of a first lateral panel 176 of the support shell 170*a* and a second baffle 178 that may be coupled to a second inner wall 179, as shown in FIG. 6, of a second lateral panel 180 of the support shell 170*a*. The first and second baffles 174, 178 may constrict a portion of the flow path 172 to define the air gap 156. As discussed in detail below, the air gap 156 may be defined as a portion of the flow path 172 that extends between a first perforated baffle sheet 182 of the first baffle 174 and a second perforated baffle sheet 184, as shown in FIG. 6, of the second baffle 178. The first and second perforated baffle sheets 182, 184 may each include a plurality of perforations or openings 183 formed therein and may extend along a height 185 of the silencer module 152*a* between cap panels 186 of the support shell 170*a*. As discussed below, the first perforated baffle sheet 182 and the second perforated baffle sheet 184 may each couple to respective guide panels 188 that form opposing end portions of the first and second baffles 174, 178. Although the guide panels 188 are shown as having a generally curved profile in the illustrated embodiments, it should be noted that, in other embodiments, the guide panels 188 may have any other suitable profile, such as, for example, a linear profile or a stepped profile.

To better illustrate the arrangement of the first and second baffles 174, 178 and their corresponding guide panels 188, FIG. 6 is a top cross-sectional view of the silencer module 152*a* taken along line 6-6 of FIG. 5. As shown in the illustrated embodiment of FIG. 6, the first baffle 174 includes a pair of guide panels 189 that are coupled to opposing sides of the first perforated baffle sheet 182. Similarly, the second baffle 178 may include a pair of guide panels 191 that are coupled to opposing sides of the second perforated baffle sheet 184. Accordingly, the guide panels 189 and the first perforated baffle sheet 182 may collectively form the first baffle 174, while the guide panels 191 and the second perforated baffle sheet 184 may collectively form the second baffle 178. The guide panels 189, 191 may each include respective flanges 190 that enable suitable fasteners or adhesives to couple the first and second baffles 174, 178 to the inner walls 175, 179 of the first lateral panel 176 and the second lateral panel 180, respectively. It should be noted that, in certain embodiments, the guide panels 189, 191 may be integrally formed with the corresponding perforated baffle sheets 182, 184. That is, the first and second baffles 174, 178 may each be a single piece component that extends between the first end portion 158 and the second end portion 160 of the silencer module 152*a*.

As shown in the illustrated embodiment, the first baffle 174 may enclose a portion of an interior of the silencer module 152*a* that extends between the first baffle 174 and the first inner wall 175 of the first lateral panel 176. Throughout the following discussion, this portion of the silencer module 152*a* will be referred to as a first chamber 192 of the first baffle 174. Similarly, the second baffle 178 may enclose an additional portion of the interior of the silencer module 152*a*, referred to herein as a second chamber 194, that extends between the second baffle 178 and the second inner wall 179 of the second lateral panel 180. The first and second chambers 192, 194 may be in fluid communication the flow path 172 via the openings 183 formed within the first and second perforated baffle sheets 182, 184. Accordingly, sound waves propagating along the flow path 172 and across the silencer module 152*a* may enter the first chamber 192, the second chamber 194, or both, via the openings 183.

In some embodiments, a noise attenuating material or a sound absorbing material 196, such as fiberglass, mineral wool, steel wool, foam, natural cotton, micro-perforated metal, or the like, may be disposed within the first and second chambers 192, 194. The sound absorbing material 196 may be configured to attenuate or substantially reduce an amplitude of the sound waves that may enter the first and second chambers 192, 194 via the openings 183. In this manner, the sound absorbing material 196 may mitigate or substantially diminish an amplitude of sound waves that may be reemitted from the first and second chambers 192, 194 and propagate into the flow path 172. As a result, the silencer module 152*a* may impede or substantially block the propagation of sound waves along the air gap 156 of the silencer module 152*a*. That is, the silencer module 152*a* may substantially reduce the propagation of audible noise from the first end portion 158 to the second end portion 160 of the silencer module 152*a*, and vice versa.

In some embodiments, the silencer module 152*a* may be substantially symmetrical across a longitudinal axis of symmetry 200 that extends generally parallel to the longitudinal axis 22, and may be substantially symmetrical across a lateral axis of symmetry 202 that extends generally parallel to the lateral axis 26. In certain embodiments, the silencer module 152*a* may also be substantially symmetrical across a vertical axis of symmetry 206 that extends generally parallel to the vertical axis 24. In some embodiments, this symmetrical configuration of the silencer module 152*a* may enable the acoustic performance of the silencer module 152*a* to remain substantially constant irrespective of a direction of air flow through the silencer module 152*a*. That is, an acoustic performance of the silencer module 152*a* may be substantially similar regardless of whether an air flow traverses the silencer module 152*a* in the downstream direction 58 or the upstream direction 168.

As shown in the illustrated embodiment, the first perforated baffle sheet 182 and the second perforated baffle sheet 184 may be oriented generally parallel to the longitudinal axis 22. Accordingly, an air gap width 208*a* of the air gap 156 or, in other words, a width of the flow path 172 along respective lengths 210 of the first and second perforated baffle sheets 182, 184, may be substantially constant. A first baffle width 212 of the first baffle 174 may be substantially equal to a second baffle width 214 of the second baffle 178. For clarity, as used herein, the "first baffle width" refers to a dimension of the first baffle 174 along the lateral axis 26 that extends between the first inner wall 175 and an outer surface 216 of the first perforated baffle sheet 182. Similarly, as used herein, the "second baffle width" refers to a dimension of the second baffle 178 along the lateral axis 26 that extends between the second inner wall 179 and an outer surface 218 of the second perforated baffle sheet 184. It should be noted that a thickness of the first lateral panel 176 and a thickness of the second lateral panel 180 of the support shell 170*a* may be negligible. Accordingly, the first baffle width 212, the second baffle width 214, and the air gap width 208*a* may collectively define an overall width 220*a* of the silencer module 152*a*. For conciseness, the first baffle width 212 and the second baffle width 214 will be collectively referred to herein as a cumulative baffle width of the silencer module 152*a*. More specifically, as used herein, "cumulative baffle width" may refer to a sum of the individual baffle widths of all baffles that may be included in a particular silencer module 152. Accordingly, as discussed in detail below with reference to FIGS. 7 and 8, the cumulative baffle width of a silencer module 152 having a single baffle will correspond to a baffle width of that single baffle. Similarly, a cumulative baffle width of a silencer module 152 having, for example, four baffles, will correspond to a combined sum of the individual baffle widths of each of the four baffles included in that particular silencer module 152.

An overall length or depth 230 of the silencer module 152*a* may refer to a dimension of the support shell 170*a* that extends along the longitudinal axis 22 from the first end portion 158 to the second end portion 160 of the silencer module 152*a*. In some embodiments, the depth 230 of the silencer module 152*a* may be less than the overall width 220*a* of the silencer module 152*a*. As shown in the illustrated embodiment, the first and second baffles 174, 178 may extend along the depth 230 of the silencer module 152*a*. More specifically, the flanges 190 of the first and second baffles 174, 178 may extend along certain portions, referred to herein as flange lengths 232, of the depth 230, while respective central portions 234 of the first and second baffles 174, 178 extend along a remaining portion, referred to herein as a baffle length 238, of the depth 230.

In some embodiments, an acoustic performance of the silencer module 152*a* may be tuned to a particular frequency range by dimensioning the silencer module 152*a* to have particular geometric relationship(s) with respect to the air gap width 208*a*, the cumulative baffle width, and/or the length 210 of the first and second perforated baffle sheets 182,184. For example, multiple experimental trials may be conducted in which the air gap width 208*a*, the cumulative baffle width, and the length 210 of the first and second perforated baffle sheets 182, 184 are systematically varied to determine a magnitude of these dimensions at which the silencer module 152*a* effectively attenuates certain frequencies of sound waves that may be generated during operation of certain components of the air handling unit 18. For example, in certain embodiments, the aforementioned dimensions of the silencer module 152*a* may be adjusted to enable the silencer module 152*a* to predominately attenuate low frequencies of sound waves that may be generated by the fan 56 of the air handling unit 18. Additionally, a relationship of the aforementioned dimensions may be adjusted to maintain a cross-sectional area of the air gap 156 at a size that is sufficient to allow substantially unimpeded air flow across the silencer module 152*a*. As a result, the silencer module 152*a* may effectively attenuate sound waves that may be generated by the air handling unit 18 while generating a predictable pressure drop along the air flow path 32 of the enclosure 30.

As a non-limiting example, it may be experimentally determined that the silencer module 152*a* may effectively attenuate sound waves generated by particular components of the air handling unit 18 when a ratio of the cumulative baffle width to the air gap width 208*a* is approximately 3:1, and a ratio of the length 210 of the perforated baffle sheets 182, 184 to the depth 230 of the silencer module 152*a* is approximately 2:3. As an example, in some embodiments, the aforementioned dimensional ratios of the silencer module 152*a* may enable the silencer module 152*a* to effectively attenuate frequencies of sound waves between 250 Hertz (Hz) and 2000 Hz, which may be predominately generated during operation of the fan 56. However, in other embodiments, the ratio of the cumulative baffle width to the air gap width 208*a*, the ratio of the length 210 of the first and second perforated baffle sheets 182, 184 to the depth 230 of the silencer module 152*a*, or both, may include various other ratios that are experimentally determined to attenuate particular frequencies of sound waves that may be generated by air handling unit 18 and/or components of the air handling unit 18. For conciseness, as used herein, the ratio of the cumulative baffle width of a particular silencer module 152 to the air gap width 208 of that particular silencer module 152 may be referred to as a "first acoustic performance ratio." The ratio of the length 210 of the perforated baffle sheets 182, 184 of a particular silencer module 152 to the depth 230 of that silencer 152 module may be referred to as a "second acoustic performance ratio."

It should be noted that, due to the substantially symmetrical configuration of the silencer module 152*a*, adjustments in the height 185 of the silencer module 152*a* may negligibly affect an acoustic performance of the silencer module 152*a*. That is, adjustments in the height 185 of the silencer module 152*a* may not alter a frequency range of sound waves that are predominately attenuated by the silencer module 152, as such height variations do not affect a value of the first and second acoustic performance ratios.

Figure 7:
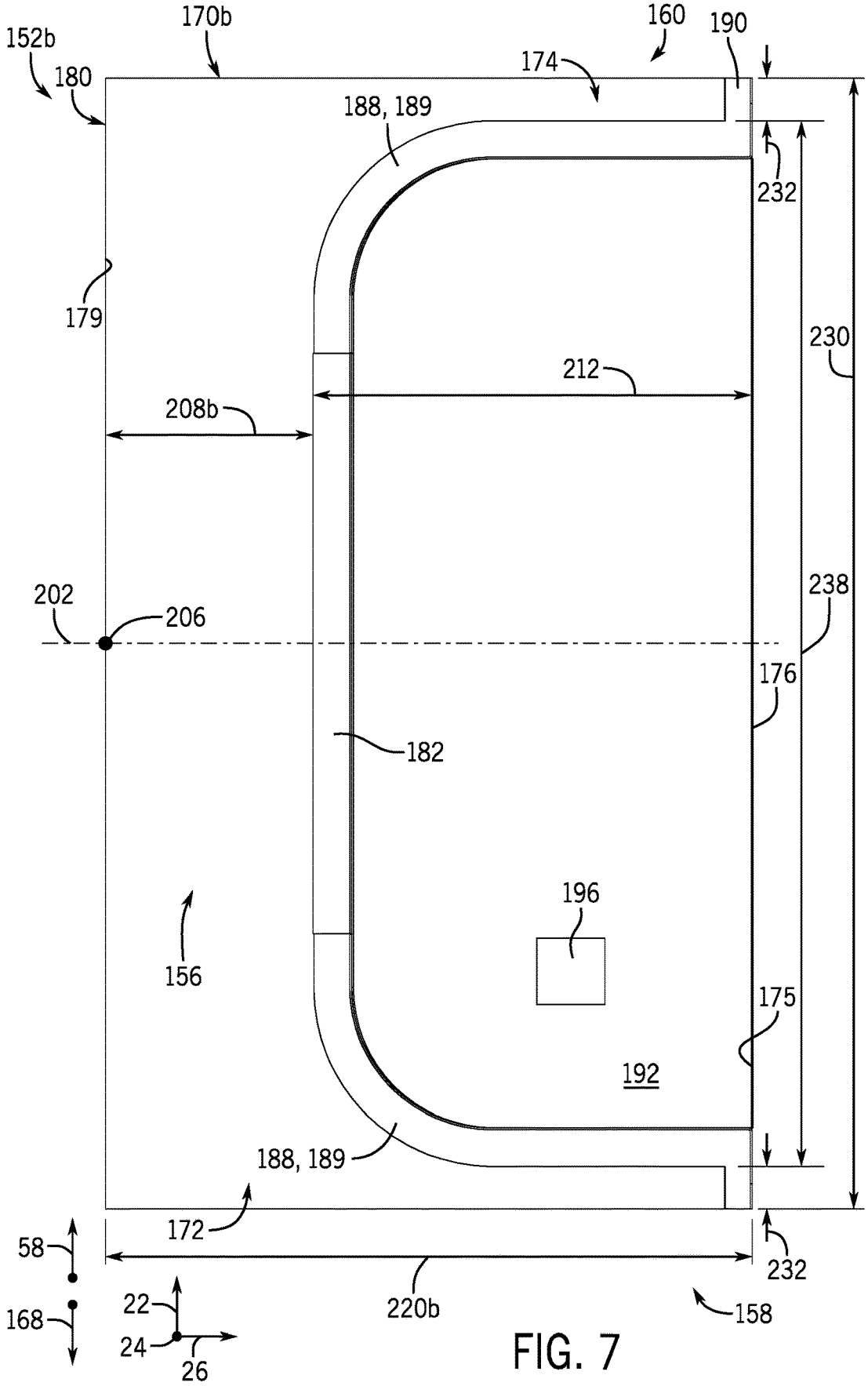
FIG. 7 is a cross-sectional top view of an embodiment of a silencer module for a silencer assembly, in accordance with an aspect of the present disclosure.

FIG. 7 is a schematic cross-sectional top view of another embodiment of the silencer module 152. In particular, the illustrated embodiment shows a silencer module 152*b* having a single baffle, such as the first baffle 174, instead of the pair of baffles 169 included in the silencer module 152*a*. For clarity, it should be noted that certain components of the silencer module 152*b* may be self-similar and/or interchangeable with components of the silencer module 152*a*. Accordingly, reference numerals associated with certain components of the silencer module 152*a* may be used to identify self-similar components of the silencer module 152*b* in later discussion.

Similar to the silencer module 152*a*, the silencer module 152*b* may be substantially symmetrical across the lateral axis of symmetry 202 and across the vertical axis of symmetry 206. In some embodiments, an overall width 220*b* of the silencer module 152*b* may be approximately half of the overall width 220*a* of the silencer module 152*a*, while the respective first baffle widths 212 of the silencer modules 152*a*, 152*b* may be substantially equal. As a result, an air gap width 208*b* of the silencer module 152*b* may be approximately half of the air gap width 208*a* of the silencer module 152*a*. However, because the cumulative baffle width of the silencer module 152*b*, which is the first baffle width 212, is approximately equal to half of the cumulative baffle width of the silencer module 152*a*, which is the sum of the first baffle width 212 and the second baffle width 214, and the air gap width 208*b* of the silencer module 152*b* is approximately equal to half of the air gap width 208*a* of the silencer module 152*a*, the first acoustic performance ratio of the silencer module 152*b* will remain substantially identical to the first acoustic performance ratio of the silencer module 152*a*. In some embodiments, the depths 230 of the silencer modules 152*a*, 152*b* may be substantially equal to one another. Accordingly, the second acoustic performance ratio of the silencer module 152*b* may be substantially equal to the second acoustic performance ratio of the silencer module 152*a*.

Assembling the silencer module 152*b* in the manner discussed above to maintain first and second acoustic performance ratios that are substantially similar to the first and second acoustic performance ratios of the silencer module 152*a* may enable both the silencer modules 152*a*, 152*b* to effectively attenuate substantially similar frequencies of sound waves. As a result, the first and second silencer modules 152*a*, 152*b* may be used interchangeably within the silencer bank 150 without altering an overall acoustic performance of the silencer bank 150. That is, the silencer bank 150 may effectively attenuate certain frequencies of acoustic energy, such as those generated by the fan 56, regardless of whether the silencer bank 150 is assembled of a plurality of the silencer modules 152*a*, a plurality of the silencer modules 152*b*, or a combination thereof. Accordingly, the silencer modules 152*a*, 152*b* may facilitate the assembly of multitudinous arrangements of silencer banks 150 that may each include a substantially similar acoustic performance. As discussed in detail below, in this manner, the silencer bank 150 may be sized in accordance with a particular size and/or geometry of the air handling unit 18 while achieving a desired acoustic performance.

Figure 8:
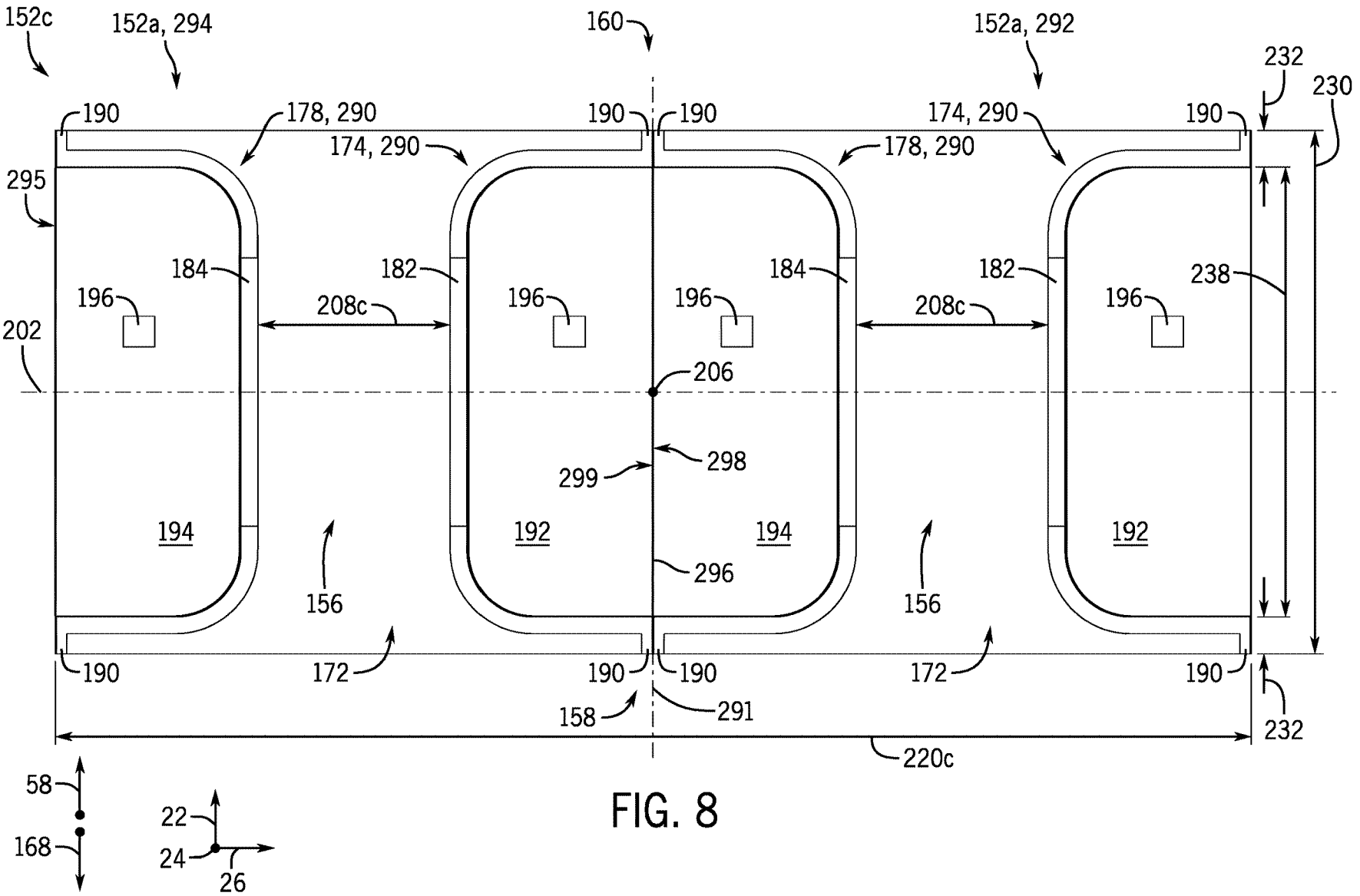
FIG. 8 is a cross-sectional top view of an embodiment of a silencer module for a silencer assembly, in accordance with an aspect of the present disclosure.

As an additional example, FIG. 8 is a schematic cross-sectional top view of another embodiment of the silencer module 152. In particular, the illustrated embodiment shows a silencer module 152*c* that includes four baffles 290 and a pair of air flow gaps 156. For clarity, it should be noted that certain components of the silencer module 152*c* may be self-similar and/or interchangeable with components of the silencer module 152*a*. Accordingly, reference numerals associated with certain components of the silencer module 152*a* may be used to identify self-similar components of the silencer module 152*c* in later discussion. Similar to the symmetrical configuration of the silencer module 152*a*, the silencer module 152*c* may be substantially symmetrical across a longitudinal axis of symmetry 291 that extend parallel to the longitudinal axis 22, across the lateral axis of symmetry 202 and across the vertical axis of symmetry 206.

In some embodiments, the silencer module 152*c* may include a pair of the silencer modules 152*a* that are positioned adjacent to one another and share a common support shell 295. That is, the silencer module 152*c* may include a first silencer module 292, which may be substantially similar to the silencer module 152*a*, positioned adjacent to a second silencer module 294, which may also be substantially similar to the silencer module 152*a*, where the first silencer module 292 and the second silencer module 294 are both encompassed by the common support shell 295 instead of respective individual support shells 170*a*. As a result, the silencer module 152*c* may include first and second acoustic performance ratios that may be substantially equal to the first and second acoustic performance ratios of the silencer module 152*a* and also the first and second acoustic performance ratios of the silencer module 152*b*. As shown in the illustrated embodiment, the first and second silencer modules 292, 294 may be partitioned by a common divider 296 that extends along the longitudinal axis 22. Accordingly, the second baffle 178 of the first silencer module 292 may couple to a first inner wall 298 of the common divider 296, while the first baffle 174 of the second silencer module 294 couples to a second inner wall 299 of the common divider 296.

Figure 9:
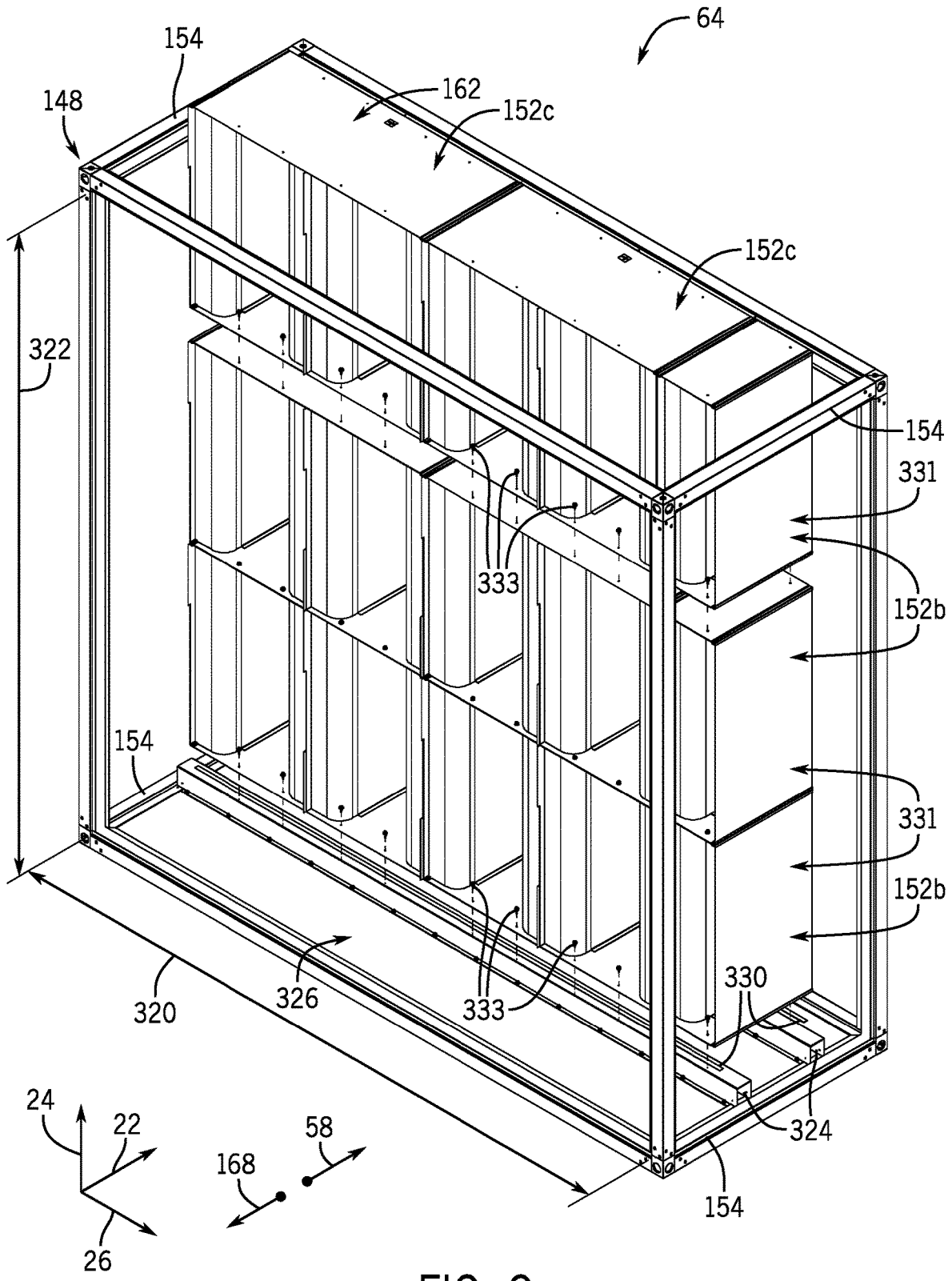
FIG. 9 is an exploded perspective view of an embodiment of a silencer assembly, in accordance with an aspect of the present disclosure.
Figure 12:
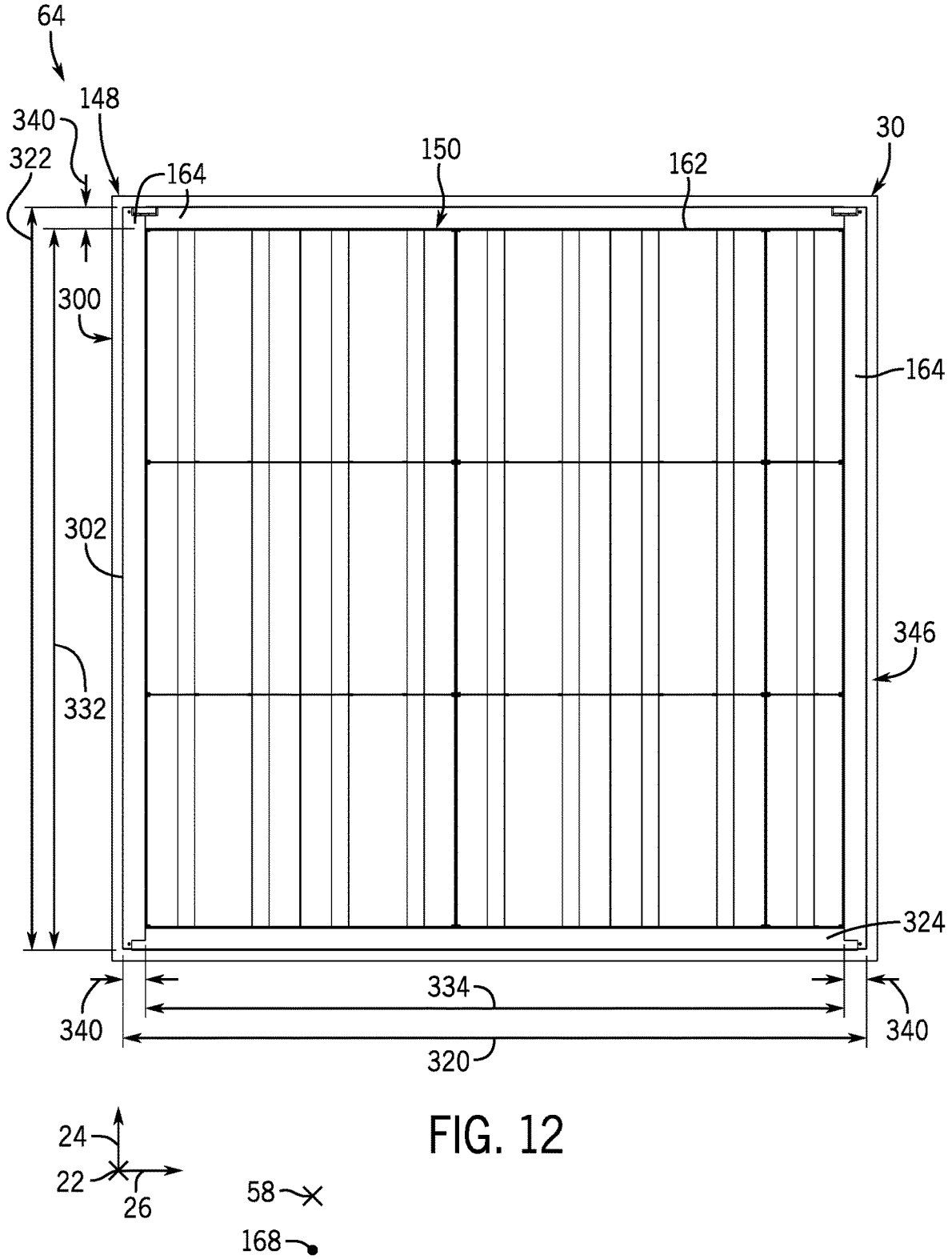
FIG. 12 is a front view of an embodiment of a silencer assembly, in accordance with an aspect of the present disclosure.

FIG. 9 is an exploded perspective view of an embodiment of the silencer assembly 64. As noted above, in certain embodiments, the support frame 148 may be coupled to and may form a portion of the enclosure 30 of the air handling unit 18. In such embodiments, one or more panels may be coupled to and disposed about an outer perimeter of the support frame 148 to form an exterior surface 300, as shown in FIG. 12, of the silencer assembly 64 and the enclosure 30. That is, the silencer assembly 64 may include panels, referred to herein as "exterior panels" of the silencer assembly 64, which are coupled to the support frame 148 to form the exterior surface 300. Similarly, the silencer assembly 64 may include one or more panels, referred to herein as "interior panels" of the silencer assembly 64, which are disposed about an inner perimeter of the support frame 148 to form an interior surface 302, as shown in FIG. 12, of the silencer assembly 64 and the enclosure 30. Accordingly, the interior surface 302 may define a portion of the air flow path 32 through the enclosure 30.

Figure 10:
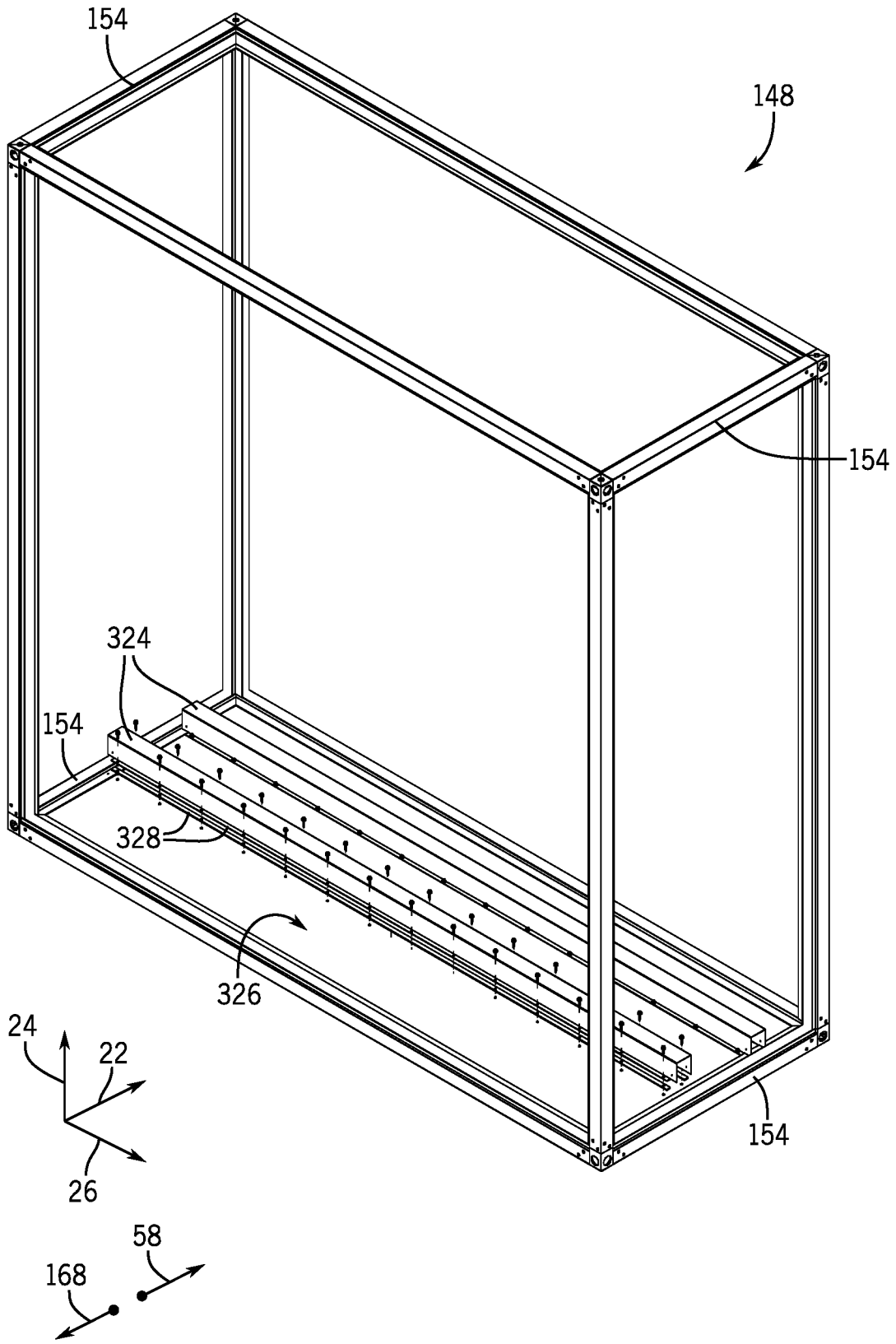
FIG. 10 is a perspective view of an embodiment of a support frame for a silencer assembly, in accordance with an aspect of the present disclosure.

The interior panels of the silencer assembly 64 may define an overall flow path width 320 of the air flow path 32, as well as an overall flow path height 322 of the air flow path 32. In the illustrated embodiment, the support frame 148 includes a pair of base rails 324 that extend generally parallel to the flow path width 320 and couple to the frame rails 154 of the support frame 148. The base rails 324 may be configured to support the silencer bank 150 within the support frame 148. In some embodiments, the base rails 324 may couple to a lower surface 326 or lower panel of the support frame 148, such as an interior panel of the silencer assembly 64, thereby substantially blocking air flow between the base rails 324 and the lower surface 326. In certain embodiments, one or more gaskets 328, as shown in FIG. 10, may be positioned between the base rails 324 and the lower surface 326 to facilitate formation of a fluid seal there between. Similar to the gaskets 328, additional gasket(s) 330 may be disposed between the base rails 324 and the silencer bank 150 to form a fluid seal between the base rails 324 and the silencer bank 150.

Figure 11:
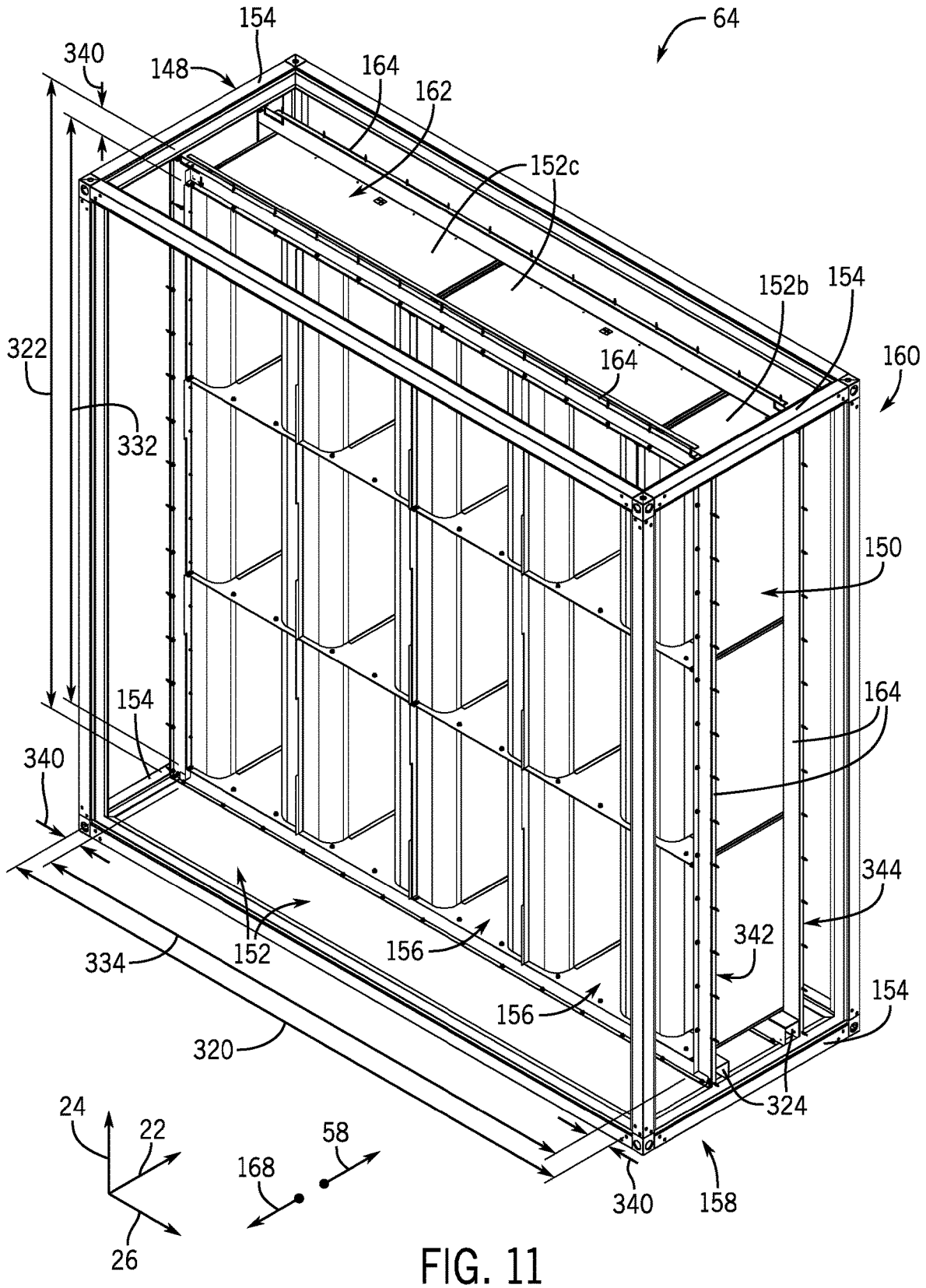
FIG. 11 is a perspective view of an embodiment of a silencer assembly in an assembled configuration, in accordance with an aspect of the present disclosure.

The flow path width 320 and the flow path height 322 may be predefined for a particular air handling unit 18. Accordingly, to assemble an embodiment of the silencer assembly 64 for the particular air handling unit 18, a combination of silencer modules 152*a*, 152*b*, and/or 152*c* may be selected that enables the silencer bank 150 to extend along as much of the flow path width 320 and the flow path height 322 of the enclosure 30 as possible without causing exterior dimensions of the silencer bank 150 to exceed the flow path width 320 and/or the flow path height 322. For example, as shown in the illustrated embodiment, the silencer bank 150 may include three rows 331 of silencer modules 152, thereby enabling the silencer bank 150 to define a bank height 332, as shown in FIG. 11, which extends along a majority of the flow path height 322. In the illustrated embodiment, each row 331 of the silencer bank 150 includes a pair of silencer modules 152*c*, and one silencer module 152*b*. Similar to the discussion above, this configuration enables the silencer bank 150 to have a bank width 334, as shown in FIG. 11, which extends along a majority of the flow path width 320 and does not exceeds the flow path width 320. It should be appreciated that the rows 331 may also include various other arrangements of silencer modules 152 in lieu of the arrangement shown in FIG. 9. As an example, in other embodiments, the silencer bank 150 may include, for example, two silencer modules 152*a*, one silencer module 152*b*, and one silencer module 152*c*, which may collectively form a bank width of the silencer bank 150 that is substantially equal to the bank width 334 of the silencer bank 150 of FIG. 11. As an additional example, in further embodiments, the silencer bank 150 may include nine silencer modules 152*b* that collectively from a bank width of the silencer bank 150 that is substantially equal to the bank width 334 of the silencer bank 150 shown in FIG. 11. In any case, as shown in the illustrated embodiment of FIG. 9, suitable fasteners 333 may be used to couple the silencer modules 152 to one another and thereby form the silencer bank 150.

It should be appreciated that various arrangement of silencer modules 152*a*, 152*b*, 152*c* may be used when assembling the silencer bank 150 for installation in particular air handling units 18. In any case, the silencer bank 150 may be assembled in a manner as to extend along as much of the flow path width 320 and the flow path height 322 of a particular air handling unit 18 as possible, without having exterior dimensions that exceed the flow path width 320 or the flow path height 322. As noted above, the silencer modules 152*a*, 152*b*, and 152*c* may each include a substantially similar acoustic performance. Advantageously, as a result, an overall acoustic performance of the silencer bank 150 may remain substantially constant irrespective of a size of the silencer bank 150 and/or the type(s) of silencer modules 152 used to assemble the silencer bank 150. Therefore, the silencer modules 152*a*, 152*b*, 152*c* may facilitate assembly of silencer banks 150 that are appropriately sized for installation in a variety of air handling units 18 while acoustic performances the silencer banks 150 remain substantially constant to one another. Accordingly, each of the assembled silencer banks 150 may effectively attenuate sound waves that may be generated by components of the air handling unit 18, such as the fan 56.

FIG. 11 is a perspective view of an embodiment of the silencer assembly 64 in an assembled configuration. In some embodiments, the silencer modules 152 may be unable to extend along substantially all of the flow path width 320 and/or substantially all of the flow path height 322 without exceeding respective dimensions of the flow path width 320 or the flow path height 322. As a result, gaps 340 may extend between one or more side portions of the silencer bank 150 and the interior panels of the of the silencer assembly 64. Accordingly, the silencer assembly 64 may include the blank-off panels 164, which are each configured to span one of the gaps 340 between the silencer bank 150 and the interior panels of the silencer assembly 64. The blank-off panels 164 may be configured to form a fluid seal between the silencer bank 150 and the interior panels of the silencer assembly 64 and, thus, substantially block air flow between the silencer bank 150 and the enclosure 30. Therefore, substantially all air flowing along the air flow path 32 may be directed across the silencer bank 150 via the air flow gaps 156, and bypass of the silencer bank 150 by the air flow may be limited or eliminated. As shown in the illustrated embodiment, the silencer assembly 64 may include a first arrangement 342 of blank-off panels 164 that are positioned near the first end portions 158 of the silencer modules 152 and a second arrangement 344 of blank-off panels 164 that are positioned near the second end portions 160 of the silencer modules 152. However, in other embodiments, the silencer assembly 64 may include a single arrangement of blank-off panels 164.

To better illustrate, FIG. 12 is a front view of an embodiment of the silencer assembly 64, illustrating the blank-off panels 164 extending between certain portions of the silencer bank 150 and interior panels of the silencer assembly 64 that define the interior surface 302. Accordingly, the blank-off panels 164 may substantially block air flow between the outer perimeter 162 of the silencer bank 150 and the interior surface 302. In some embodiments, a noise attenuating material, such as the sound absorbing material 196, may be disposed within a space 346 formed between the interior surface 302 and the outer perimeter 162 of the silencer bank 150, and/or a space formed between the exterior surface 300 and the interior surface 302. This noise attenuating material may impede the propagation of sound waves through the space 346 and across the silencer bank 150.

Technical effects of the silencer assembly 64 may include improved noise attenuation along the air flow path 32 of the enclosure 30. Specifically, the silencer assembly 64 may effectively attenuate frequencies of acoustic energy that are typically generated during operation of certain components of the air handling unit 18, such as the fan 56, before these sound waves may propagate into, for example, the cooling load 38. Further, the various silencer modules 152 of the silencer assembly 64 may enable customized assembly configurations of the silencer bank 150 while an acoustic performance of the silencer bank 150 remains substantially constant.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A silencer module for a silencer bank of an air handling unit, comprising:

a support shell comprising a first lateral panel and a second lateral panel opposite the first lateral panel;

a first baffle coupled to the first lateral panel, wherein the first baffle comprises a first perforated baffle sheet; and a second baffle coupled to the second lateral panel, wherein the second baffle comprises a second perforated baffle sheet, wherein an air flow gap extends between the first perforated baffle sheet and the second perforated baffle sheet, the support shell defines a depth of the silencer module that extends along a direction of air flow through the air flow gap, the support shell defines an overall width of the silencer module that extends from the first lateral panel to the second lateral panel, and the overall width of the silencer module is greater than the depth of the silencer module.

2. The silencer module of claim 1, wherein the first baffle defines a first chamber of the silencer module extending between the first baffle and the first lateral panel, and the second baffle defines a second chamber of the silencer module extending between the second baffle and the second lateral panel.

3. The silencer module of claim 2, wherein the first chamber is in fluid communication with the air flow gap via a first plurality of openings formed in the first perforated baffle sheet, and the second chamber is in fluid communication with the air flow gap via a second plurality of openings formed in the second perforated baffle sheet.

4. The silencer module of claim 2, comprising sound attenuation material disposed within the first chamber, disposed within the second chamber, or both.

5. The silencer module of claim 4, wherein the sound attenuation material comprises fiberglass, mineral wool, steel wool, foam, natural cotton, micro-perforated metal, or a combination thereof.

6. The silencer module of claim 1, wherein the air flow gap comprises a constant width along the first perforated baffle sheet and the second perforated baffle sheet in the direction of air flow through the air flow gap, wherein the constant width extends from the first perforated baffle sheet to the second perforated baffle sheet.

7. The silencer module of claim 1, comprising:

a first pair of guide panels coupled to first opposing ends of the first perforated baffle sheet and coupled to the first lateral panel, wherein the first pair of guide panels and the first perforated baffle sheet collectively form the first baffle; and a second pair of guide panels coupled to second opposing ends of the second perforated baffle sheet and coupled to the second lateral panel, wherein the second pair of guide panels and the second perforated baffle sheet collectively form the second baffle.

8. The silencer module of claim 7, wherein at least one guide panel of the first pair of guide panels is curved, at least one guide panel of the second pair of guide panels is curved, or both.

9. The silencer module of claim 1, wherein:

the first baffle defines a first baffle width extending from the first lateral panel to first perforated baffle sheet, the second baffle defines a second baffle width extending from the second lateral panel to second perforated baffle sheet, and the first baffle width and the second baffle width are equal to one another.

10. The silencer module of claim 1, wherein the silencer module is symmetrical about a longitudinal axis of the silencer module, a lateral axis of the silencer module, a vertical axis of the silencer module, or a combination thereof.

11. A silencer for an air handling unit, comprising:

a support frame; and a plurality of silencer modules arrayed within the support frame, wherein each silencer module of the plurality of silencer modules comprises:

a support shell;

a first perforated baffle sheet coupled to a first lateral panel of the support shell; and a second perforated baffle sheet coupled to a second lateral panel of the support shell opposite the first lateral panel, wherein an air flow gap extends from the first perforated baffle sheet to the second perforated baffle sheet, the support shell defines a depth of the silencer module that extends along a direction of air flow through the air flow gap, the support shell defines an overall width of the silencer module that extends from the first lateral panel to the second lateral panel, and the overall width of the silencer module is greater than the depth of the silencer module.

12. The silencer of claim 11, wherein the plurality of silencer modules comprises a first plurality of silencer modules arrayed along a width of the air handling unit and a second plurality of silencer modules arrayed along a height of the air handling unit.

13. The silencer of claim 11, wherein the plurality of silencer modules defines a silencer bank, and the silencer bank comprises a plurality of blank-off panels extending about a perimeter of the silencer bank between the silencer bank and the support frame.

14. The silencer of claim 13, comprising a plurality of interior panels extending about an inner perimeter of the support frame, wherein the plurality of blank-off panels extends from the perimeter of the silencer bank to the plurality of interior panels to form a space between the perimeter of the silencer bank and the inner perimeter of the support frame, wherein the silencer comprises sound attenuation material disposed within the space.

15. The silencer of claim 11, wherein at least one silencer module of the plurality of silencer modules comprises sound attenuation material disposed between the first perforated baffle sheet and the first lateral panel of the support shell and between the second perforated baffle sheet and the second lateral panel of the support shell.

16. The silencer of claim 11, wherein each silencer module of the plurality of silencer modules comprises:

a first pair of guide panels coupled to first opposing ends of the first perforated baffle sheet and coupled to the first lateral panel; and a second pair of guide panels coupled to second opposing ends of the second perforated baffle sheet and coupled to the second lateral panel.

17. A silencer bank for an air handling unit, comprising:

a plurality of silencer modules configured to be positioned and arrayed within a support frame of the air handling unit, wherein each silencer module of the plurality of silencer modules comprises:

a support shell comprising a first lateral panel; and a first baffle coupled to the first lateral panel of the support shell, wherein the first baffle comprises a first perforated baffle sheet and a pair of guide panels coupled to opposing ends of the first perforated baffle sheet and coupled to the first lateral panel, wherein the first perforated baffle sheet at least partially defines an air flow gap extending through the silencer module and configured to direct an air flow through the silencer bank, and the air flow gap comprises a constant width along the first perforated baffle sheet in a direction of the air flow through the air flow gap.

18. The silencer bank of claim 17, wherein a first silencer module of the plurality of silencer modules further comprises:

an additional lateral panel of the support shell; and an additional baffle coupled to the additional lateral panel of the support shell, wherein the additional baffle comprises an additional perforated baffle sheet and an additional pair of guide panels coupled to additional opposing ends of the additional perforated baffle sheet and coupled to the additional lateral panel, wherein a first width of the air flow gap of the first silencer module extends from the first perforated baffle sheet to the additional perforated baffle sheet.

19. The silencer bank of claim 18, wherein a second silencer module of the plurality of silencer modules further comprises a second lateral panel of the support shell, and a second width of the air flow gap of the second silencer module extends from the first perforated baffle sheet to the second lateral panel.

20. The silencer bank of claim 18, wherein the support shell of the first silencer module defines a depth of the first silencer module that extends along the direction of the air flow through the air flow gap, the support shell of the first silencer module defines an overall width of the first silencer module that extends from the first lateral panel to the additional lateral panel, and the overall width of the first silencer module is greater than the depth of the first silencer module.

* * * * *